United States Patent [19]

Atsuyuki

[11] 4,361,113

[45] Nov. 30, 1982

[54] APPARATUS FOR PAINTING THE INNER SURFACE OF THE SIDE SEAM OF A CAN BODY

[75] Inventor: Wakamatsu Atsuyuki, Shimizu, Japan

[73] Assignee: Daiwa Can Company, Limited, Tokyo, Japan

[21] Appl. No.: 295,315

[22] Filed: Aug. 24, 1981

[51] Int. Cl.[3] ..... B05C 1/02; B05C 7/08

[52] U.S. Cl. ..... 118/694; 118/69; 118/212; 118/215; 118/248

[58] Field of Search ..... 118/215, 214, 212, 248, 118/244, 694, 69, DIG. 15

[56] References Cited

U.S. PATENT DOCUMENTS 2,685,861 8/1954 Webb ..... 118/215

4,249,476 2/1981 Opprecht et al. ..... 118/215 X

*Primary Examiner*—John P. McIntosh

*Attorney, Agent, or Firm*—Wenderoth, Lind & Ponack

[57] ABSTRACT

An apparatus for painting the inner surface of the welded side seam of a can body with its top and bottom open. The apparatus uses an applicator roll having an annular projection with an acute vertical angle formed in the middle and both edges of the outer periphery.

2 Claims, 10 Drawing Figures

APPARATUS FOR PAINTING THE INNER SURFACE OF THE SIDE SEAM OF A CAN BODY

BACKGROUND OF THE INVENTION

This invention relates to an improved apparatus for painting the side seam on the inner surface of a can body in an automatic can welder. More particularly, this invention relates to a painting apparatus included in a welder of the type wherein a cylindrical member with both ends open is advanced with its longitudinal axis being horizontal and with the parts to form a side seam being at the top, and the overlapping portion to form a side seam is passed between upper and lower electrodes and welded to form a can body with both ends open and having a side seam, and then, the can is advanced horizontally with the side seam being at the top while the inner surface of the side seam is coated with paint.

A conventional painting apparatus of the type contemplated by this invention is hereunder described by reference to FIG. 1 which is a schematic representation of an applicator in an automatic welder wherein a can body A with both ends open is passed between upper and lower electrically conductive rolls (not shown) to form a side seam S by resistance seam welding, and the can then is advanced horizontally, with the side seam being at the top, in the direction indicated by the arrow Z as it is guided by a supporting member 100 while the inner surface of the side seam is coated with paint.

The supporting member 100 has a diameter smaller than that of the can body A and is positioned horizontally so that it supports and guides the can body as it penetrates the latter. The member 100 has applicator means made of a paint vessel 104 and an applicator roll 106 in the vessel as means to paint the side seam S. The paint vessel 104 may be formed by boring the member 100 or it may be formed separately from the member 100. In most cases, the applicator means is positioned close to the farthest end of the member 100 in the direction in which the can body is advanced (as indicated by the arrow Z).

The supporting member 100 is fixed on its left-hand end (not shown), and a roller 122 is provided on the leading end (the right-hand end in FIG. 1). The member 100 is supported, not fixed, by a roller 121 right under the roller 122 to support the latter, and hence, keep the whole of the member 100 (including an applicator drive mechanism to be described hereunder) horizontal.

Above the supporting member 100 is a can body advancing device composed of an endless belt 101 rotating in the direction indicated by the arrow Y and a magnet 102 fixed on the lower travel 103 of the belt. When the can body A comes under the lower travel 103, it is attracted by the magnet 102 and is sent to the position of A′ by passing through the supporting member 100 as it remains in contact with the underside of the belt 101. During the travel to the position of A′, the inside surface of the side seam S is coated with paint.

The applicator roll 106 rotates in the direction of the arrow X to apply paint to the inner surface of the side seam. The roll 106 is driven by an endless chain 107 which in turn is driven by a fixed sprocket coaxial with a gear 108 which engages a gear (not shown) coaxial with a pulley 109 which is driven by a belt 113 put around pulleys 110 and 111. A resilient member 112 is placed between the pulleys 110 and 111. The member 112 forces the belt 113 toward a lower belt 117 put around pulleys 114 and 115 (positioned beneath the pulleys 110 and 111) and a tension pulley 116. The belts 113 and 117 are then brought into frictional engagement and the belt 113 is driven by the belt 117. The belt 117 is driven by the rotation of a pulley 118 coaxial with the pulley 115, whereas the pulley 118 is driven by a belt 119 put around said pulley 118 and a pulley 120 which is connected to a driving mechanism not shown.

Needless to say, the roller 122 and the applicator roll drive mechanism (107 to 113) are positioned within the passageway of the can body along the supporting member 100 so that they do not interfere with the passage of the can body A. To be more specific, the side portion C of the can body A is passed between the belts 113 and 117 that are held in contact with each other, then is advanced under the paint vessel 104, and is finally passed between the rollers 112 and 121.

The paint vessel 104 is supplied with paint by conventional means, and has a detector in the vessel that detects a change in the paint level. The tip of the detector is indicated at 123.

The applicator system described above has the following disadvantages. The conventional applicator roll used in the apparatus shown in FIG. 1 has an outer periphery with a single shallow groove 136 made therein as shown in FIG. 2. With such a roll, a low-viscosity paint (about 50 sec/25° C. through #4 Ford cup) can be applied to the inner surface of the side seam, but because of the low viscosity, the resulting paint film is very thin. If a high-viscosity paint (about 150–380 sec/25° C. in #4 Ford cup) is used, the paint adheres and remains little to both edge parts of the area to be painted by the applicator roll. To keep highly corrosive foods in a welded can for an extended period of time, the side seam must be covered with a thick protective film.

A thick protective film may be obtained by multi-painting of such a low-viscosity paint as described above, but it is apparently time-consuming. If we want to obtain a desired thick film by a single-application of a paint, we must use a high-viscosity paint of the type described above. But, this is not satisfied by the conventional applicator.

SUMMARY OF THE INVENTION

One object of this invention is to provide an apparatus for painting the inner surface of the side seam of a can body that is capable of applying a high-viscosity paint that cannot be applied with the conventional apparatus and forming a desired thick protective film by a single-application of the paint.

Another object of this invention is to provide an apparatus for painting the inner surface of the side seam that uses an applicator roll of a configuration that differs from that of the roll used in the conventional apparatus to thereby achieve the application of a high-viscosity paint.

Still another object of this invention is to provide an applicator that can be easily used in the conventional apparatus for painting the inner surface of the side seam to permit the application of a high-viscosity paint that cannot be applied by the conventional application apparatus.

These and other objects and advantages of this invention will be apparent by reading the following description in conjunction with the accompanying drawings.

The following apparatuses are provided according to this invention.

(1) An apparatus for painting the inner surface of the side seam a can body with both ends open, said side seam being formed by resistance seam welding and then painted as the can body is advanced in a horizontal direction with the side seam being at the top, said apparatus including a can body advancing device; a supporting member having side seam painting means composed of a paint vessel and an applicator roll and which guides the advancing can body while keeping it horizontal; an applicator roll drive device; a roller that is positioned under the foremost end of the supporting member and which supports said member horizontally; and means to detect the level of the paint in the paint vessel, said apparatus being characterized by having an annular projection with an acute vertical angle formed in the middle and both edges of the outer periphery of the applicator roll.

(2) An apparatus for painting the inner surface of the side seam of a can body with both ends open, said side seam being formed by resistance seam welding and then painted as the can body is advanced in a horizontal direction with the side seam being at the top, said apparatus including a can body advancing device; a supporting member having side seam painting means composed of a paint vessel and an applicator roll and which guides the advancing can body while keeping it horizontal; an applicator roll drive device; a roller that is positioned under the foremost end of the supporting member and which supports said member horizontally; and means to detect the level of the paint in the paint vessel, said apparatus being characterized in that an annular projection with an acute vertical angle is formed in the middle and both edges of the outer periphery of the applicator roll and that a device for blowing cool air onto the advancing can body to cool the side seam is provided above the supporting member and between a welding position and a painting position.

DETAILED DESCRIPTION OF PREFERRED EMBODIMENTS

Figure 1:
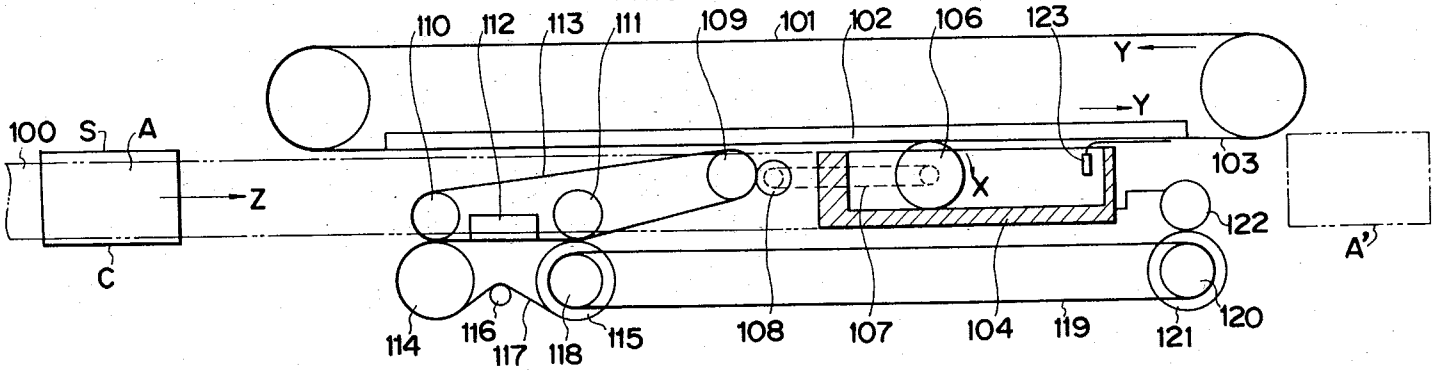
FIG. 1 PRIOR ART
FIG. 1 is a side elevation of the conventional applicator system that schematically shows how the can body to be painted is passed through the applicator.

Preferred embodiments of this invention are hereunder described by reference to the accompanying drawings. The applicator apparatus of this invention is characterized by the configuration of the outer periphery of an applicator roll 1060 which, as shown best in FIG. 4, is provided with an annular projection 39 (end projection) having an acute vertical angle on both edges of the outer periphery, and an annular projection 40 (center projection) also with an acute vertical angle in the middle of the outer periphery. The three projections 39 and 40 define two grooves 36, 36 serving as a paint reservoir. By using such applicator roll, we found that high-viscosity paint can be applied to the inner surface of the side seam that is fresh from the welding step and is still hot, although the reason why this is possible is not known. The resulting paint film has a thickness sufficient for practical purposes the applicator apparatus system we used was the same as that shown in FIG. 1 except for the applicator roll.

Figure 2:
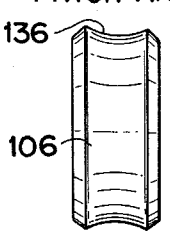
FIG.2 PRIOR ART
FIG. 2 is a front view of an applicator used in the conventional applicator system.
Figure 3A:
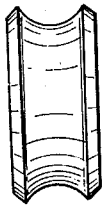
FIGS. 3A, 3B, 3C and 3D are front views of applicator rolls used as controls in our experiment.
Figure 3B:
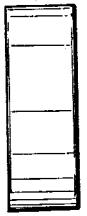
Figure 3C:
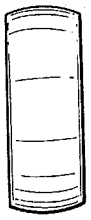
Figure 3D:
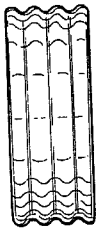

As mentioned already, it has been known that a thick paint film cannot be obtained with the conventional roll described in FIG. 2. Therefore, I tried to apply a low-viscosity paint of the type described above using an applicator roll that was of the same configuration but which had the groove 136 made deeper than that of the roll shown in FIG. 2, but a satisfactorily thick film could not still be obtained. The same result was obtained when the paint was replaced by a high-viscosity paint (about 200 sec/25° C. through #4 Ford cup). Three other rolls were prepared then: a roll with a flat surface (FIG. 3B), a roll with a slightly outwardly curved surface (FIG. 3C), and a roll with a corrugated surface (FIG. 3D). But as in the case of the roll shown in FIG. 3A, none of these rolls produced a satisfactorily thick film.

But I found that a paint as thick as 200$\mu$ could be produced by using a roll having a configuration as described above and as shown in FIG. 4A. It is to be understood that the width of the groove 36 and the height of the projections 39 and 40, as well as the angle by which these projections are inclined are properly determined by such factors as the viscosity of the paint and the temperature of the side seam.

Figure 4B:
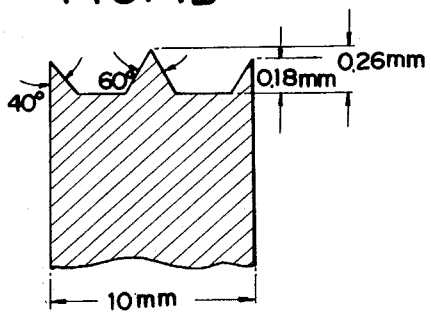
FIG. 4B is a partially enlarged cross section of FIG. 4A.
Figure 4A:
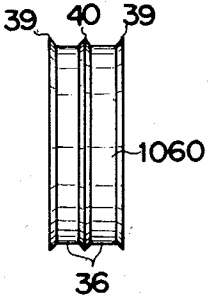
FIG. 4A is a front view of an applicator roll according to this invention.

FIG. 4B shows an applicator roll of our own fabrication which proved to be very effective in applying high-viscosity paint. The roll was a disc 10 mm thick (i.e. the width of the outer periphery was 10 mm) and 36 mm in diameter that was made of quenched steel. The roll had an annular projection 39 on both edges of the outer periphery that was in the form of a right-angled triangle 0.18 mm high and whose angle of inclination was 40°, and an annular projection 40 in the middle of the outer periphery that was in the form of an equilateral triangle 0.26 mm high and which had a vertical angle of 60°. These projections defined two grooves each having a width of 4.7 mm. With this roll; a high-viscosity vinyl oragnosol (250 sec/25° C. through #4 Ford cup) was begun to be applied to the side seam after 1.4 seconds from the completion of the welding. The resulting paint film had a thickness of about 180$\mu$ that was sufficient as a protective coating on the inner surface of the side seam.

Figure 5:
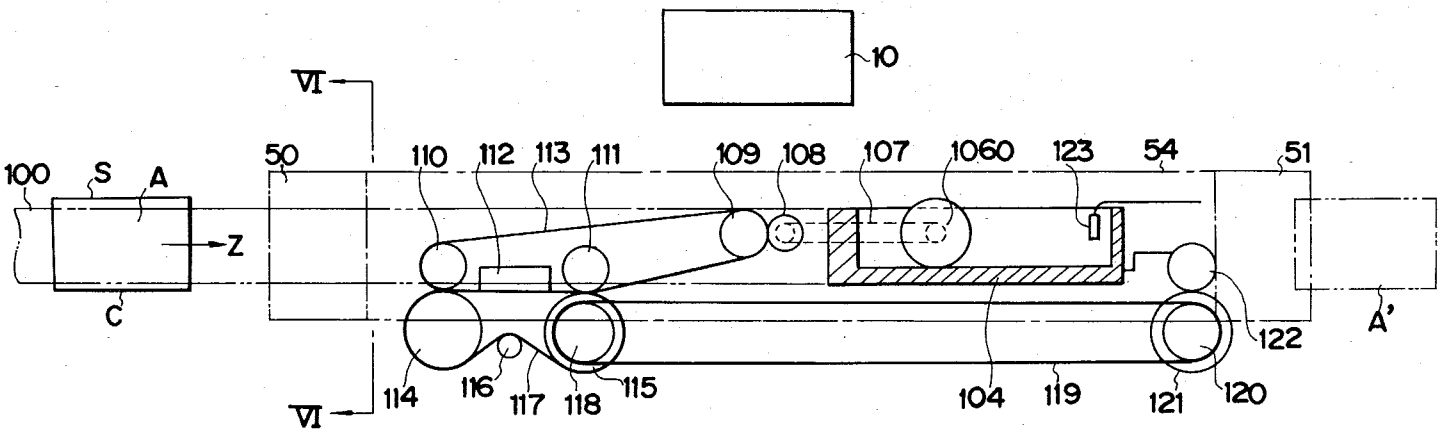
FIG. 5 is a side elevation of an applicator system using an applicator roll and a cooling nozzle according to this invention.

A thick paint film is easier to produce when the temperature of the side seam to be painted is low than when it is high. Therefore, we designed an applicator apparatus which, as shown schematically in FIG. 5, included a cool air blowing nozzle 10 provided above the supporting member 100 and ahead of the applicator roll 1060 so that the hot side seam coming from the welding zone could be cooled before application of paint. By this arrangement, the interval between the welding step and painting step could be reduced in comparison with the case of the absence of the cooling nozzle 10. In our experiment, when the side seam was cooled with the air from the nozzle 10, a film of the desired thickness could be obtained in an interval of about one second between the welding and the paint application.

Figure 6:
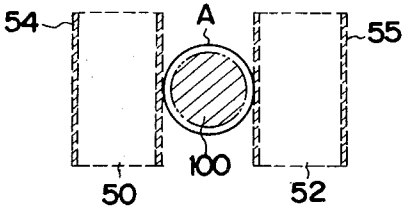
FIG. 6 is a cross section of FIG. 5 taken on the line VI—VI.

To provide the cooling nozzle 10, the can body advancing device (belt 101 in FIG. 1) may be replaced by a symmetrical arrangement of rollers 50 and 51 that are positioned on one side of the supporting member 100 and which are rotated by suitable drive means and another symmetrical arrangement of rollers 52 and 53 that are positioned on the other side of the member 100 and which are likewise rotated by suitable drive means. The two sets of rollers are represented by the dash line in FIG. 5. As understood from FIG. 6, an endless belt 54 is put around the rollers 50 and 51, and another endless belt 55 put around the rollers 52 and 53, and the can body A is advanced as it is held between the two belts.

According to this invention, paint can be applied to the side seam of a can body which is fresh from the welding zone and is still hot, and now a thick film can be produced, and this has been impossible with the conventional applicator system. Therefore, the invention is capable of providing a film that satisfactorily protects the side seam from highly corrosive contents such as tomato purée.

What is claimed is:

1. An apparatus for painting the inner surface of the side seam of a can body with both ends open, said side seam being formed by resistance seam welding and then painted as the can body is advanced in a horizontal direction with the side seam being at the top, said apparatus including a can body advancing device; a supporting member having side seam painting means composed of a paint vessel and an applicator roll and which guides the advancing can body while keeping it horizontal; an applicator roll drive device; a roller that is positioned under the foremost end of the supporting member and which supports said member horizontally; and means to detect the level of the paint in the paint vessel, said apparatus being characterized by having an annular projection with an acute vertical angle formed in the middle and both edges of the outer periphery of the applicator roll.

2. An apparatus for painting the inner surface of the side seam of a can body with both ends open, said side seam being formed by resistance seam welding and then painted as the can body is advanced in a horizontal direction with the side seam being at the top, said apparatus including a can body advancing device; a supporting member having side seam painting means composed of a paint vessel and an applicator roll and which guides the advancing can body while keeping it horizontal; an applicator roll drive device; a roller that is positioned under the foremost end of the supporting member and which supports said member horizontally; and means to detect the level of the paint in the paint vessel, said apparatus being characterized in that an annular projection with an acute vertical angle is formed in the middle and both edges of the outer periphery of the applicator roll and that a device for blowing cool air onto the advancing can body to cool the side seam is provided above the supporting member and between a welding position and a painting position.

* * * * *